US009988953B2

(12) United States Patent
Kisaichi

(10) Patent No.: US 9,988,953 B2
(45) Date of Patent: Jun. 5, 2018

(54) INTERNAL COMBUSTION ENGINE

(71) Applicant: HONDA MOTOR CO., LTD., Tokyo (JP)

(72) Inventor: Toru Kisaichi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 142 days.

(21) Appl. No.: 15/275,814

(22) Filed: Sep. 26, 2016

(65) Prior Publication Data

US 2017/0089231 A1 Mar. 30, 2017

(30) Foreign Application Priority Data

Sep. 30, 2015 (JP) ..... 2015-192719

(51) Int. Cl.

| | |
|---|---|
| ***F01L 13/08*** | (2006.01) |
| ***F01L 1/26*** | (2006.01) |
| ***F01L 1/053*** | (2006.01) |
| ***F02B 75/16*** | (2006.01) |
| ***F02D 13/02*** | (2006.01) |

(Continued)

(52) U.S. Cl.

CPC ..... *F01L 13/08* (2013.01); *F01L 1/053* (2013.01); *F01L 1/181* (2013.01); *F01L 1/26* (2013.01); *F01L 1/267* (2013.01); *F01L 13/085* (2013.01); *F02B 75/16* (2013.01); *F02D 13/0249* (2013.01); *F02D 13/0273* (2013.01); *F01L 2001/0535* (2013.01); *F01L 2013/108* (2013.01)

(58) Field of Classification Search

CPC . F01L 13/08; F01L 13/085; F01L 1/26; F01L 1/181; F01L 1/053; F01L 2013/108; F01L 2001/0535; F01L 1/267; F02D 13/0273; F02D 13/0249; F02B 75/16

USPC ..... 123/90.16

See application file for complete search history.

(56) References Cited

U.S. PATENT DOCUMENTS

| | | | | |
|---|---|---|---|---|
| 4,656,977 A * | 4/1987 | Nagahiro | ..... | F01L 13/0063 123/198 F |
| 2008/0011257 A1* | 1/2008 | Iwama | ..... | F01L 1/053 123/90.31 |
| 2012/0266836 A1 | 10/2012 | Arvan | | |

FOREIGN PATENT DOCUMENTS

| | | |
|---|---|---|
| CN | 202125328 U | 1/2012 |
| JP | 2000-282818 A | 10/2000 |

(Continued)

*Primary Examiner* — Mark Laurenzi
*Assistant Examiner* — Wesley Harris
(74) *Attorney, Agent, or Firm* — Birch, Stewart, Kolasch & Birch, LLP

(57) ABSTRACT

An internal combustion engine for increasing the freedom of the layout of a rocker arm wherein the rocker arm is lighter. The internal combustion engine includes a camshaft having a first exhaust cam and a second exhaust cam, a first exhaust valve, and a second exhaust valve. The internal combustion engine further includes a first rocker arm for actuating the first exhaust valve to open and close, a second rocker arm for actuating the second exhaust valve to open and close, and a decompression mechanism for lifting the first rocker arm in a valve opening direction at the timing of a compression stroke initiated by the internal combustion engine. The first rocker arm and the second rocker arm are provided with an angular movement transmitter for transmitting a turning force produced by a decompression operator in the valve opening direction from the first rocker arm to the second rocker arm.

20 Claims, 6 Drawing Sheets

(51) Int. Cl.
*F01L 1/18* (2006.01)
*F01L 13/00* (2006.01)

(56) References Cited

FOREIGN PATENT DOCUMENTS

| | | | |
|---|---|---|---|
| JP | 2008-019845 | A | 1/2008 |
| JP | 2008-82297 | A | 4/2008 |

* cited by examiner

INTERNAL COMBUSTION ENGINE

CROSS-REFERENCE TO RELATED APPLICATIONS

The present application claims priority under 35 USC 119 to Japanese Patent Application No. 2015-192719 filed Sep. 30, 2015 the entire contents of which are hereby incorporated by reference.

BACKGROUND OF THE INVENTION

1. Field of the Invention

The present invention relates to an internal combustion engine which is provided with a decompression mechanism for reducing the compression pressure in the combustion chamber to facilitate the startup of the internal combustion engine when the internal combustion engine is starting to operate.

2. Description of Background Art

An internal combustion engine is known that is provided with a decompression mechanism for reducing the compression pressure when the internal combustion engine starts to operate. See, for example, Japanese Patent Laid-Open No. 2008-19845.

The decompression mechanism reduces a load on the internal combustion engine when it is starting to operate, by opening exhaust valves in timed relation to a compression stroke at the startup of the internal combustion engine. Normally, the decompression mechanism is incorporated in camshaft portions for rotationally actuating the exhaust cams.

In the internal combustion engine disclosed in Japanese Patent Laid-Open No. 2008-19845, an intake cam and an exhaust cam are provided on a camshaft that rotates in ganged relation to a crankshaft, and a plunger that serves as a decompression operator is projectably and retractably mounted on the camshaft at a position adjacent to the exhaust cam. The plunger is projected or retracted depending on the rotation of a decompression shaft supported on the camshaft, and the decompression shaft is angularly moved in response to forces from a return spring and a decompression weight. The return spring normally urges the decompression shaft to turn in a direction to project the plunger, and the decompression weight turns the decompression shaft in a direction to retract the plunger under centrifugal forces depending on the rotational speed of the camshaft. The plunger is projected or retracted at a position adjacent to a base-circle portion of the exhaust cam.

When the internal combustion engine starts to operate, the plunger is projected by the biasing force from the return spring, and pushes an exhaust valve in a valve opening direction through an exhaust rocker arm at the timing of a compression stroke of the internal combustion engine. As a result, the exhaust valve opens an exhaust port at the timing of the compression stroke initiated by the exhaust valve, reducing the compression pressure in the combustion chamber. When the rotational speed of the camshaft reaches a prescribed rotational speed or higher after the internal combustion engine has started to operate, the decompression weight retracts the plunger to cancel the decompression process.

The internal combustion engine disclosed in Japanese Patent Laid-Open No. 2008-19845 is an internal combustion engine of the type wherein two intake valves and two exhaust valves are disposed in one cylinder. On the camshaft, there are disposed a single common exhaust cam for opening and closing the two exhaust valves and two intake cams for opening and closing the two intake valves individually. The exhaust rocker arm has a cam operator (roller abutment) on one end thereof and a bifurcated valve actuator extending on the other end, which is spaced from the one end across a rocker shaft, for pushing the two intake valves. When the internal combustion engine starts to operate, the cam operator on the exhaust rocker arm is pressed by the plunger as the decompression operator, simultaneously pushing the two exhaust valves open to a small degree.

In the internal combustion engine disclosed in Japanese Patent Laid-Open No. 2008-19845, the compression pressure in the combustion chamber can quickly be reduced by opening the two exhaust valves at the time the internal combustion engine starts to operate. With the internal combustion engine, however, since the exhaust rocker arm is of a structure having the single cam operator and the bifurcated valve actuator, it is necessary that the exhaust rocker arm, which is symmetrically shaped, be disposed at an intermediate position between the two exhaust valves. Therefore, the layout of the rocker arm is limited. If the rocker arm is asymmetrically shaped, then the rocker arm needs to be of an increased thickness for reducing twisting and vibration of its own when the internal combustion engine is in normal operation, making it difficult to reduce the weight of a valve actuating mechanism.

SUMMARY AND OBJECTS OF THE INVENTION

Therefore, it is an object of an embodiment of the present invention to provide an internal combustion engine which increases the degree of freedom for the layout of a rocker arm and makes the rocker arm smaller in weight.

To solve the above problems, according to an embodiment of the present invention an internal combustion engine includes a camshaft (14) having a first exhaust cam (17A) and a second exhaust cam (17B) on an outer circumferential surface thereof. The camshaft (14) is rotatable in ganged relation to rotation of a crankshaft. A first exhaust valve (10A) opens and closes a first exhaust port which faces a combustion chamber. A second exhaust valve (10B) opens and closes a second exhaust port which faces the combustion chamber. A first rocker arm (22A) actuates the first exhaust valve (10A) to open and close by being pushed by the first exhaust cam (17A). A second rocker arm (22B) actuates the second exhaust valve (10B) to open and close by being pushed by the second exhaust cam (17B). A decompression mechanism (28) is rotatable in unison with the first exhaust cam (17A) for projecting a decompression operator (29) to lift the first rocker arm (22A) in a valve opening direction at a timing of a compression stroke initiated by the internal combustion engine when a rotational speed of the camshaft (14) is lower than a predetermined rotational speed, and retracting the decompression operator (29) when the rotational speed of the camshaft (14) is equal to or higher than the predetermined rotational speed. The first rocker arm (22A) and the second rocker arm (22B) are provided with an angular movement transmitter (40) transmitting a turning force produced by the decompression operator (29) in the valve opening direction from the first rocker arm (22A) to the second rocker arm (22B).

According to an embodiment of the present invention, when the internal combustion engine starts to operate, the decompression operator (29) of the decompression mechanism (28) is projected to lift the first rocker arm (22A) in the valve opening direction at the timing of the compression stroke initiated by the internal combustion engine. At this time, when the first rocker arm (22A) is turned by an operating force received from the decompression operator (29), the turning force thereof is transmitted to the second rocker arm (22B) by the angular movement transmitter (40), and the second rocker arm (22B) is also lifted in the valve opening direction in synchronism with the first rocker arm (22A). As a result, the first exhaust valve (10A) and the second exhaust valve (10B) are similarly opened, quickly reducing the compression pressure in the combustion chamber of the internal combustion engine.

According to an embodiment of the present invention, the angular movement transmitter (40) may include a pair of protrusions (22A-b, 22B-b) projecting toward each other from respective rocker arm bodies (22A-a, 22B-a) of the first rocker arm (22A) and the second rocker arm (22B) and abutting against each other when the first rocker arm (22A) is turned in the valve opening direction by the decompression operator (29).

In this case, the respective rocker arm bodies (22A-a, 22B-a) of the first rocker arm (22A) and the second rocker arm (22B) do not need to be enlarged, but the operating force from the decompression operator (29) can be transmitted from the first rocker arm (22A) to the second rocker arm (22B) by abutting engagement between the protrusions (22A-b, 22B-b).

The protrusions (22A-b, 22B-b) may be disposed on the closest portions of mutually facing surfaces of the rocker arm body (22A-a) of the first rocker arm (22A) and the rocker arm body (22B-a) of the second rocker arm (22B).

According to an embodiment of the present invention, the protruding lengths of the protrusions (22A-b, 22B-b) can be shortened to reduce a load imposed on the protrusions (22A-b, 22B-b) when the decompression operator (29) operates.

The protrusion (22A-b) projecting from the first rocker arm (22A) may be joined to the rocker arm body (22A-a) of the first rocker arm (22A) by a progressively spreading contiguous arcuate surface (36).

According to an embodiment of the present invention, the rigidity of the joint between the protrusion (22A-b) and the rocker arm body (22A-a) is increased by the progressively spreading contiguous arcuate surfaces (36), making it possible to quickly transmit the operating force produced by the decompression operator (29) to the second rocker arm (22B).

The angular movement transmitter (40) may have a first abutting surface (33) on the first rocker arm (22A) and a second abutting surface (34) on the second rocker arm (22B), which abut against each other when the first rocker arm (22A) is turned by the decompression operator (29), and a clearance (C) may be provided between the first abutting surface (33) and the second abutting surface (34) when the decompression operator (29) is not in operation.

According to an embodiment of the present invention, while the internal combustion engine is in a normal operation with the decompression operator (29) being not in operation, the first abutting surface (33) and the second abutting surface (34) are held out of contact with each other. If the cam profiles of the first exhaust cam (17A) and the second exhaust cam (17B) suffer an error, for example, then the second rocker arm (22B) is prevented from following and being pushed by the first rocker arm (22A), preventing a gap from being formed between abutting portions of the second exhaust cam (17B) and the second rocker arm (22B). Therefore, the second exhaust cam (17B) and the second rocker arm (22B) are prevented in advance from producing abutment sounds and being unduly worn.

According to an embodiment of the present invention, the angular movement transmitter (40) may have a first abutting surface (33) on the first rocker arm (22A) and a second abutting surface (34) on the second rocker arm (22B), which abut against each other when the first rocker arm (22A) is turned by the decompression operator (29), and at least one of the first abutting surface (33) and the second abutting surface (34) may be formed as an arcuate surface.

According to an embodiment of the present invention, even if the first rocker arm (22A) and the second rocker arm (22B) are relatively inclined with respect to each other due to an error caused when they are assembled together, since at least one of the first abutting surface (33) and the second abutting surface (34) which face each other is formed as an arcuate surface (36), the area where the first abutting surface (33) and the second abutting surface (34) abut against each other is less likely to vary. This structure, therefore, is effective to prevent the degree to and the timing at which the second exhaust valve (10B) is opened from varying when the decompression process is performed.

According to an embodiment of the present invention, inasmuch as the first rocker arm and the second rocker arm are provided with the angular movement transmitter for transmitting the turning force produced by the decompression operator in the valve opening direction from the first rocker arm to the second rocker arm, the first rocker arm and the second rocker arm can be constructed as respective independent members, and the second rocker arm can be ganged with the first rocker arm in operation only when the decompression mechanism operates. Therefore, the first rocker arm and the second rocker arm can be positioned in a layout with a high degree of freedom, and can be of a simple structure that is less susceptible to twisting and vibration. Therefore, the first rocker arm and the second rocker arm are prevented from increasing in thickness, making it possible to reduce their overall weight.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described below with reference to the drawings.

Figure 1:
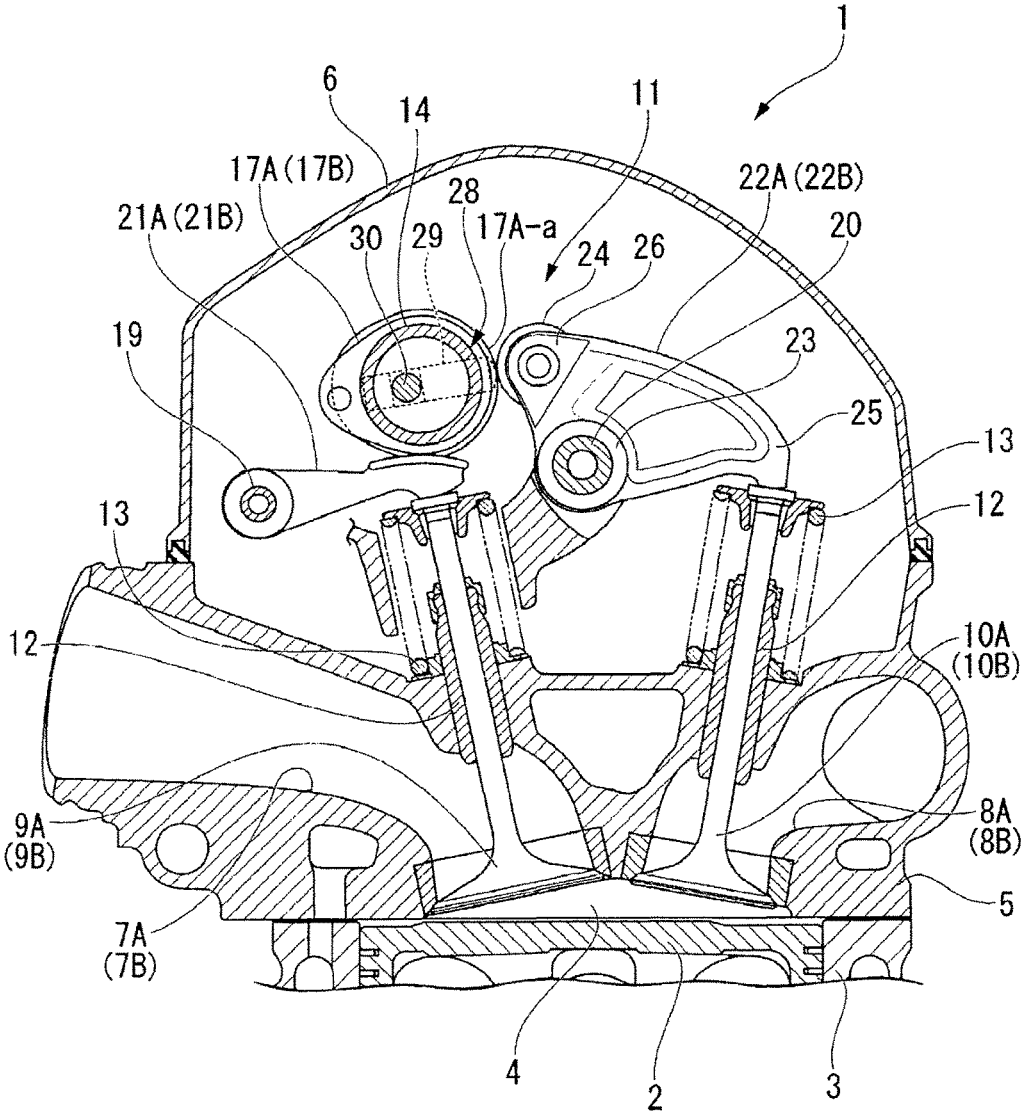
FIG. 1 is a vertical cross-sectional view of a portion of an internal combustion engine according to an embodiment of the present invention.

FIG. 1 is a vertical cross-sectional view of a portion of an internal combustion engine 1 according to the present embodiment.

The internal combustion engine 1 according to the present embodiment is a single-cylinder reciprocating internal combustion engine for use on motorcycles or the like. The internal combustion engine 1 has a cylinder 3 in which a piston 2 is slidably fitted, a cylinder head 5 mounted on an upper portion of the cylinder 3 and cooperating with a top surface of the piston 2 in defining a combustion chamber 4, and a cylinder head cover 6 covering an upper portion of the cylinder head 5. The cylinder head 5 has defined therein a first intake port 7A and a second intake port 7B which face the combustion chamber 4, and also a first exhaust port 8A and a second exhaust port 8B which face the combustion chamber 4. The second intake port 7B is disposed behind the first intake port 7A in a direction away from the viewer of the sheet of FIG. 1, and has its reference symbols depicted in parentheses where the first intake port 7A is indicated. Similarly, the second exhaust port 8B is disposed behind the first exhaust port 8A in the direction away from the viewer of the sheet of FIG. 1, and has its reference symbols depicted in parentheses where the first exhaust port 8A is indicated. Other members that overlap each other in the direction away from the viewer of the sheet of FIG. 1 are also similarly illustrated.

In the upper portion of the cylinder head 5, there are disposed a first intake valve 9A and a second intake valve 9B for opening and closing the first intake port 7A and the second intake port 7B, respectively, and a first exhaust valve 10A and a second exhaust valve 10B for opening and closing the first exhaust port 8A and the second exhaust port 8B, respectively. The first and second intake valves 9A and 9B and the first and second exhaust valves 10A and 10B are slidably fitted in respective sleeves 12 press-fitted in the cylinder head 5, and are normally biased in a direction to be closed under the resilient forces of valve springs 13.

A vale actuating mechanism 11 for actuating the first and second intake valves 9A and 9B and the first and second exhaust valves 10A and 10B to open and close the corresponding ports in synchronism with the rotation of a crankshaft, not depicted, is disposed over the upper portion of the cylinder head 5.

Figure 2:
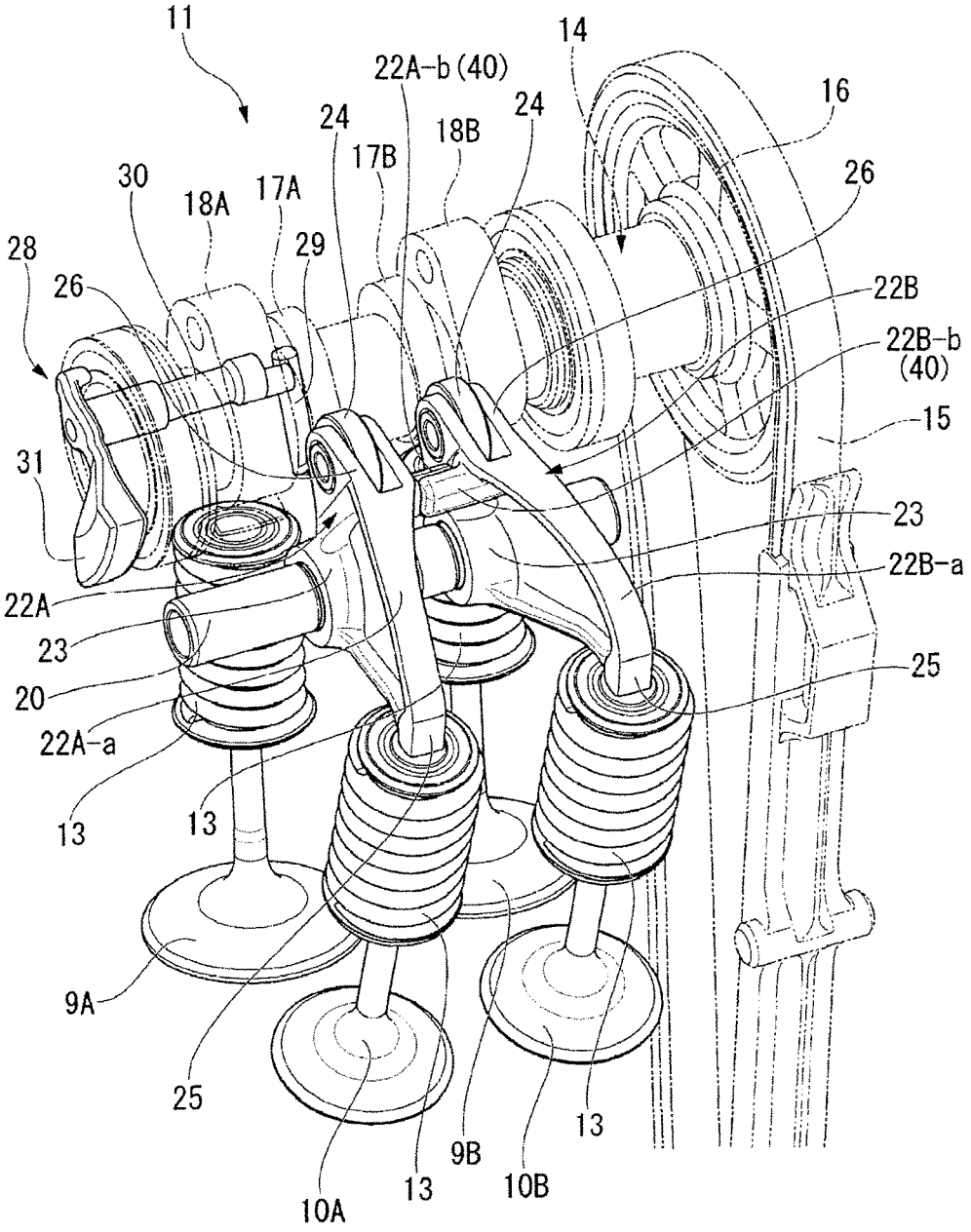
FIG. 2 is a perspective view of a valve actuating mechanism of the internal combustion engine according to the embodiment of the present invention.
Figure 3:
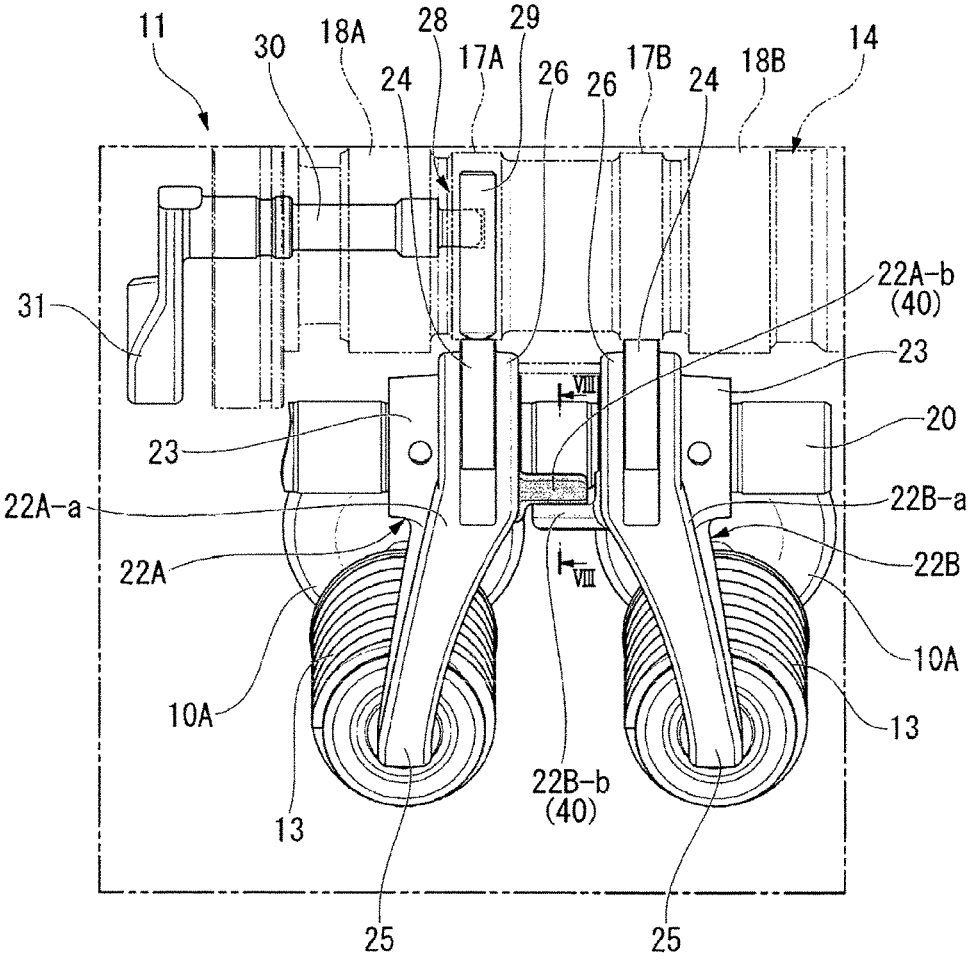
FIG. 3 is a top plan view of the valve actuating mechanism of the internal combustion engine according to the embodiment of the present inventionY.

FIG. 2 is a view depicting the valve actuating mechanism 11 as viewed obliquely from above, and FIG. 3 is a view depicting the valve actuating mechanism 11 as viewed from above.

As depicted in FIGS. 1 through 3, the valve actuating mechanism 11 has a camshaft 14 rotatably supported on the cylinder head 5 by bearings. A driven sprocket 16 to which rotation is transmitted from the crankshaft by a timing belt 15 is mounted on an axial end of the camshaft 14. The camshaft 14 includes a first exhaust cam 17A and a second exhaust cam 17B which are positioned axially adjacent to each other, a first intake cam 18A which is positioned axially outwardly of the first exhaust cam 17A, and a second intake cam 18B which is positioned axially outwardly of the second exhaust cam 17B. An intake rocker shaft 19 and an exhaust rocker shaft 20 are disposed parallel to the camshaft 14 on the cylinder head 5. An intake first rocker arm 21A and an intake second rocker arm 21B are angularly movably supported on the intake rocker shaft 19. An exhaust first rocker arm 22A and an exhaust second rocker arm 22B are angularly movably supported on the exhaust rocker shaft 20.

The valve actuating mechanism 11 is made up of the camshaft 14, the first and second intake cams 18A and 18B and the first and second exhaust cams 17A and 17B on the camshaft 14, and the intake first and second rocker arms 21A and 21B and the exhaust first and second rocker arms 22A and 22B which are held in abutting engagement with the first and second intake cams 18A and 18B and the first and second exhaust cams 17A and 17B.

The intake first rocker arm 21A opens and closes the first intake valve 9A under pushing forces received from the first intake cam 18A, and the intake second rocker arm 21B opens and closes the second intake valve 9B under pushing forces received from the second intake cam 18B. The exhaust first rocker arm 22A opens and closes the first exhaust valve 10A under pushing forces received from the first exhaust cam 17A, and the exhaust second rocker arm 22B opens and closes the second exhaust valve 10B under pushing forces received from the second exhaust cam 17B.

The exhaust first rocker arm 22A and the exhaust second rocker arm 22B have respective rocker arm bodies 22A-a and 22B-a formed as castings which are of a substantially triangular shape as viewed in a side elevation. The rocker arm bodies 22A-a and 22B-a have on corners thereof bosses 23 that are rotatably supported on the exhaust rocker shaft 20, and on other corners thereof roller holders 26 that hold rollers 24 which bear pressing forces from the corresponding exhaust cams (the first exhaust cam 17A and the second exhaust cam 17B). The rocker arm bodies 22A-a and 22B-a have on remaining corners thereof valve actuators 25 held in abutting engagement with the ends of the corresponding exhaust valves (the first exhaust valve 10A and the second exhaust valve 10B).

The camshaft 14 is provided with a decompression mechanism 28 for reducing the compression pressure in the combustion chamber 4 by depressing the first exhaust valve 10A in a valve opening direction the timing of a compression stroke when the internal combustion engine 1 starts to operate.

The decompression mechanism 28 includes a plunger 29 as a decompression operator which is projectably and retractably mounted on the camshaft 14 at a position adjacent to the first exhaust cam 17A, a decompression shaft 30 rotatably held by the camshaft 14 for projecting or retracting the plunger 29 depending on the angle through which the decompression shaft 30 is turned, a return spring, not depicted, for normally biasing the decompression shaft 30 to turn in a direction to project the plunger 29, and a decompression weight 31 rotatable in unison with the camshaft 14 for turning the decompression shaft 30 in a direction to retract the plunger 29 under centrifugal forces.

As depicted in FIG. 1, the plunger 29 of the decompression mechanism 28 can project radially outwardly at a position corresponding to a base-circle portion 17A-a of the first exhaust cam 17A. The plunger 29 has a tip end 29*a* that can project radially outwardly from the camshaft 14 into abutment against the roller 24 on the first rocker arm 22A.

Figure 4:
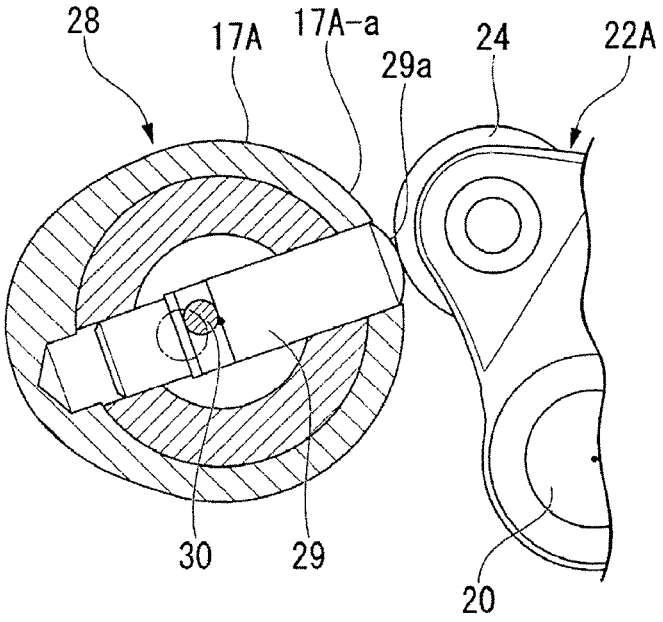
FIG. 4 is a cross-sectional view of the actuating mechanism of the internal combustion engine according to the embodiment of the present invention, the view being taken along a direction perpendicularly across the axial direction of a camshaft.
Figure 5:
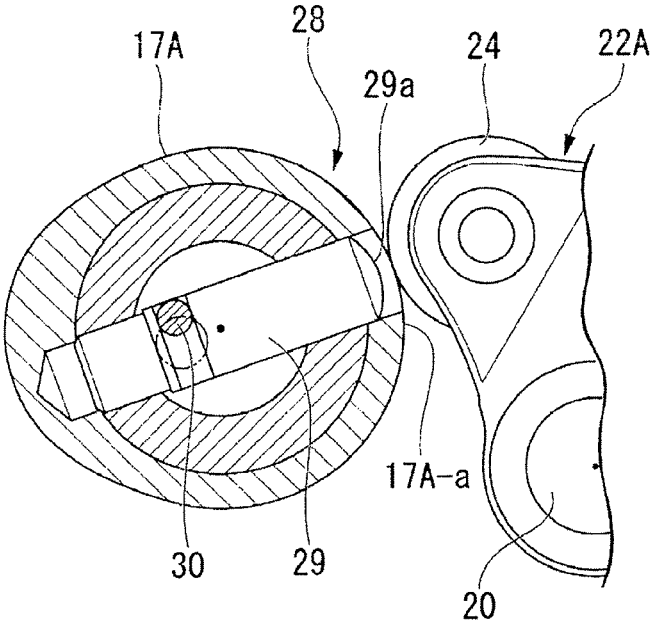
FIG. 5 is a cross-sectional view of the actuating mechanism of the internal combustion engine according to the embodiment of the present invention, the view being taken along a direction perpendicularly across the axial direction of the camshaft.

FIG. 4 is a view depicting the way in which the plunger 29 and the first rocker arm 22A behave when the rotational speed of the camshaft 14 acting on the decompression weight 31 is lower than a prescribed rotational speed. FIG. 5 is a view depicting the way in which the plunger 29 and the first rocker arm 22A behave when the rotational speed of the camshaft 14 acting on the decompression weight 31 is equal to or higher than the prescribed rotational speed. According to the present embodiment, the prescribed rotational speed is essentially set to the cranking speed of the internal combustion engine.

As depicted in FIG. 5, when the plunger 29 is retracted, it is held out of contact with the roller 24 (the first rocker arm 22A). As depicted in FIG. 4, when the plunger 29 is projected outwardly, it is brought into direct contact with the roller 24, lifting the first rocker arm 22A. Therefore, when the rotational speed of the camshaft 14 is lower than the prescribed rotational speed as when the internal combustion engine 1 starts to operate, the plunger 29 lifts the first rocker arm 22A by a predetermined distance at the timing of a compression stroke of the internal combustion engine 1, thereby opening the first exhaust valve 10A, as depicted in FIG. 4. When the rotational speed of the camshaft 14 becomes equal to or higher than the prescribed rotational speed when the startup of the internal combustion engine 1 is completed, the plunger 29 is retracted, canceling the opening of the first exhaust valve 10A at the timing of a compression stroke, as depicted in FIG. 5.

Figure 6:
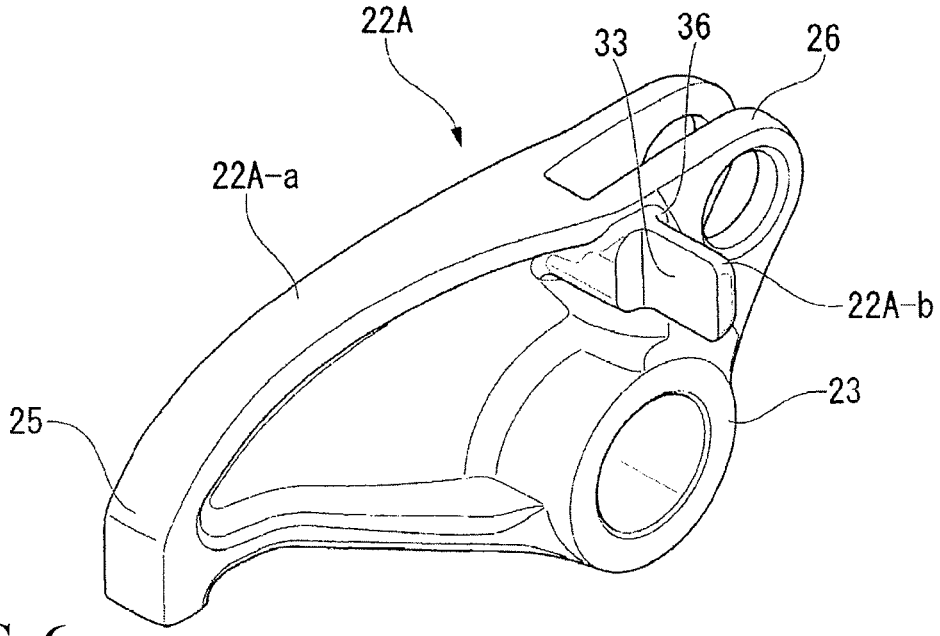
FIG. 6 is a perspective view of a first rocker arm of the internal combustion engine according to the embodiment of the present invention.
Figure 7:
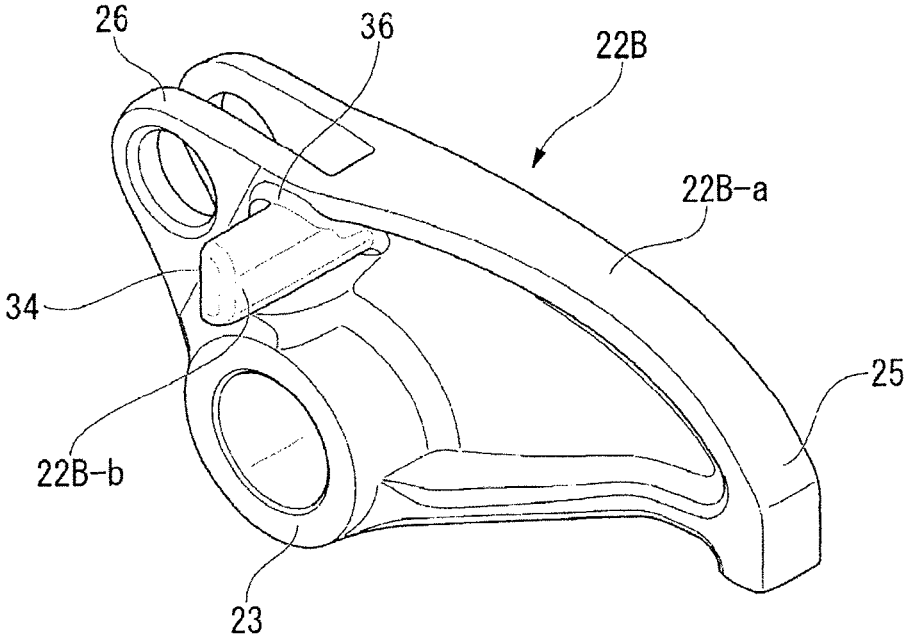
FIG. 7 is a perspective view of a second rocker arm of the internal combustion engine according to the embodiment of the present invention.

FIGS. 6 and 7 are views depicting the exhaust first rocker arm 22A and the exhaust second rocker arm 22B, respectively, as viewed obliquely from above.

As depicted in FIGS. 2 and 3, the rocker arm bodies 22A-a and 22B-a of the first rocker arm 22A and the second rocker arm 22B as they are installed on the exhaust rocker shaft 20 are curved so that their bosses 23 and roller holders 26 have proximity portions positioned closest to each other and their valve actuators 25 are spaced away from each other toward extended ends. As depicted in FIGS. 6 and 7, protrusions 22A-b and 22B-b are provided in confronting relation to each other in the vicinity of the roller holders 26 on mutually facing side surfaces of the rocker arm bodies 22A-a and 22B-a. The protrusions 22A-b and 22B-b project to such a height that they axially overlap each other.

Figure 8:
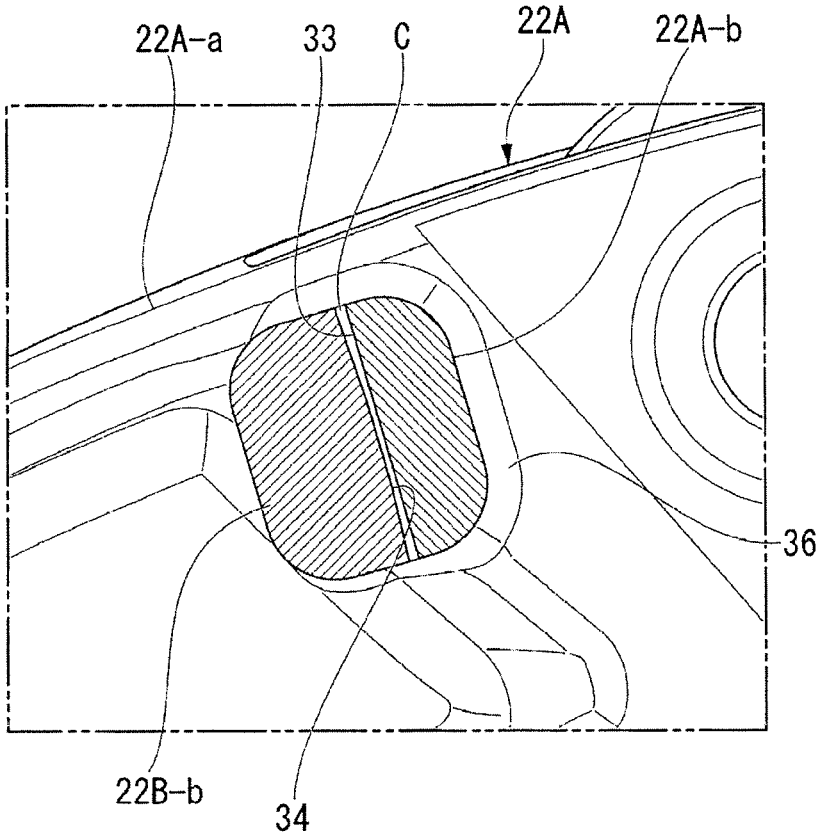
FIG. 8 is a cross-sectional view of the internal combustion engine according to the embodiment of the present invention, the view being taken along line VIII-VIII of FIG. 3.

FIG. 8 is a cross-sectional view taken along line VIII-VIII of FIG. 3.

As depicted in FIG. 8, the protrusion 22A-b of the first rocker arm 22A and the protrusion 22B-b of the second rocker arm 22B have a first abutting surface 33 and a second abutting surface 34, respectively, which can abut against each other. The first abutting surface 33 is formed so that when the first rocker arm 22A is turned in a valve opening direction (a direction to open the first exhaust valve 10A), the first abutting surface 33 is oriented toward the valve opening direction. The second abutting surface 34 is formed so that when the first rocker arm 22A is turned in the valve opening direction (the direction to open the first exhaust valve 10A), the second abutting surface 34 confronts the first abutting surface 33 of the first rocker arm 22A head on.

When the first rocker arm 22A is turned in the valve opening direction by being pushed by the plunger 29 of the decompression mechanism 28 at the time the internal combustion engine 1 starts to operate, the first abutting surface 33 of the protrusion 22A-b abuts against the second abutting surface 34 of the protrusion 22B-b of the second rocker arm 22B, thereby transmitting the turning force in the valve opening direction from the first rocker arm 22A to the second rocker arm 22B. The second exhaust valve 10B is now opened in synchronism with the first exhaust valve 10A.

According to the present embodiment, the pair of protrusions 22A-b and 22B-b make up an angular movement transmitter 40 for transmitting the turning force in the valve opening direction from the first rocker arm 22A to the second rocker arm 22B.

According to the present embodiment, furthermore, as depicted in FIG. 8, the first abutting surface 33 is formed flatwise, whereas the second abutting surface 34 is formed as an arcuate surface which is curved so as to be centrally projected. Conversely, the second abutting surface 34 may be formed flatwise, whereas the first abutting surface 33 may be formed as an arcuate surface. Alternatively, both the first abutting surface 33 and the second abutting surface 34 may be arcuate surfaces.

As depicted in FIG. 8, moreover, a clearance C is kept between the first abutting surface 33 and the second abutting surface 34 when the plunger 29 is retracted (when the decompression operator is not in operation).

The protrusion 22A-b of the first rocker arm 22A and the protrusion 22B-b of the second rocker arm 22B have respective proximal ends joined to the rocker arm bodies 22A-a and 22B-a, respectively, by progressively spreading arcuate surfaces 36.

In the internal combustion engine 1 according to the present embodiment, as described above, the angular movement transmitter 40 is provided between the first rocker arm 22A and the second rocker arm 22B, and the turning force produced by the plunger 29 of the decompression mechanism 28 in the valve opening direction is transmitted from the first rocker arm 22A to the second rocker arm 22B by the angular movement transmitter 40. Consequently, the first rocker arm 22A and the second rocker arm 22B are constructed as respective independent members, and the second rocker arm 22B is ganged with the first rocker arm 22A in an operation only when the decompression process is performed by the decompression mechanism 28.

In the internal combustion engine 1 according to the present embodiment, consequently, the first rocker arm 22A and the second rocker arm 22B can be positioned independently of each other in a layout with a high degree of freedom, and can be of a simple structure that is less susceptible to twisting and vibration without involving an increase in their thickness. Therefore, the structure of the internal combustion engine 1 makes it possible to reduce the weight of the overall valve actuating mechanism 11 by avoiding an increase in the thickness of the first rocker arm 22A and the second rocker arm 22B.

In the internal combustion engine 1 according to the present embodiment, furthermore, the angular movement transmitter 40 includes the pair of protrusions 22A-b and 22B-b projecting toward each other from the respective rocker arm bodies 22A-a and 22B-a of the first rocker arm 22A and the second rocker arm 22B and abutting against each other when the first rocker arm 22A is turned in the valve opening direction by the plunger 29 of the decompression mechanism 28. In the internal combustion engine 1 according to the present embodiment, therefore, the respective rocker arm bodies 22A-a and 22B-a of the first rocker arm 22A and the second rocker arm 22B do not need to be enlarged, but the decompression force from the plunger 29 can be transmitted from the first rocker arm 22A to the second rocker arm 22B by abutting engagement between the protrusions 22A-b and 22B-b. Consequently, this structure described above makes it possible to reduce the size and weight of the valve actuating mechanism 11.

In the internal combustion engine 1 according to the present embodiment, moreover, the pair of protrusions 22A-b and 22B-b that make up the angular movement transmitter 40 are disposed on the closest portions of the mutually facing surfaces of the rocker arm body 22A-a of the first rocker arm 22A and the rocker arm body 22B-a of the second rocker arm 22B. Therefore, in the internal combustion engine 1 according to the present embodiment, the protruding lengths of the protrusions 22A-b and 22B-b can be shortened to reduce a load imposed on the protrusions 22A-b and 22B-b when the decompression process is performed by the plunger 29.

In the internal combustion engine 1 according to the present embodiment, furthermore, the proximal ends of the protrusions 22A-b and 22B-b projecting from the first rocker arm 22A and the second rocker arm 22B are joined to the rocker arm bodies 22A-a and 22B-a, respectively, by the progressively spreading contiguous arcuate surfaces 36. With this structure, consequently, the rigidity between the proximal ends of the protrusions 22A-b and 22B-b and the rocker arm bodies 22A-a and 22B-a is increased by the progressively spreading contiguous arcuate surfaces 36, making it possible to quickly transmit the decompression force produced by the plunger 29 to the second rocker arm 22B.

In the internal combustion engine 1 according to the present embodiment, moreover, the angular movement transmitter 40 has the first abutting surface 33 of the first rocker arm 22A and the second abutting surface 34 of the second rocker arm 22B, and when the plunger 29 of the decompression mechanism 28 is retracted, the clearance C is created between the first abutting surface 33 and the second abutting surface 34. Therefore, while the internal combustion engine 1 is in a normal operation, the first abutting surface 33 and the second abutting surface 34 are held out of contact with each other.

If the cam profiles of the first exhaust cam 17A and the second exhaust cam 17B suffer a slight error, then when the internal combustion engine 1 according to the present embodiment starts to operate, the first abutting surface 33 and the second abutting surface 34 are prevented from abutting against each other, preventing the second rocker arm 22B from following and being pushed by the first rocker arm 22A. Therefore, when the internal combustion engine 1 is in a normal operation, the roller 24 on the second rocker arm 22B is prevented from being temporarily spaced from and then abutting against the cam surface of the second exhaust cam 17B, producing abutment sounds, and the roller 24 and the cam surface of the second exhaust cam 17B are prevented in advance from being unduly worn by a repetition of abutment and separation between the roller 24 and the second exhaust cam 17B.

In the internal combustion engine 1 according to the present embodiment, furthermore, the protrusion 22A-b of the first rocker arm 22A and the protrusion 22B-b of the second rocker arm 22B have the first abutting surface 33 and the second abutting surface 34, respectively, which abut against each other in the decompression process, and at least one of the first abutting surface 33 and the second abutting surface 34 is an arcuate surface curved so as to be projected toward the confronting member. Therefore, even if the first rocker arm 22A and the second rocker arm 22B are relatively inclined with respect to each other due to an error caused when they are assembled together, the area where the first abutting surface 33 and the second abutting surface 34 abut against each other is less likely to vary. This structure, therefore, is effective to prevent the degree to and the timing at which the second exhaust valve 10B is opened from varying when the decompression process is performed.

The present invention is not limited to the above embodiment, but it is possible to make various design changes to the embodiment without departing from the scope of the invention. For example, while the pair of protrusions 22A-b and 22B-b that are capable of abutting against each other make up the angular movement transmitter 40 in the above embodiment, the angular movement transmitter may be of any of other structures such as in the form of a combination of a protrusion and a recess or the like insofar as they are capable of transmitting angular movement forces through mutual abutment thereof. The decompression mechanism is not limited to a structure wherein a plunger is projectable and retractable in radial directions of a camshaft, but may be of any of other structures insofar as the decompression operator lifts the first exhaust cam when the internal combustion engine starts to operate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a camshaft having a first exhaust cam and a second exhaust cam on an outer circumferential surface thereof, said camshaft being rotatable in ganged relation to rotation of a crankshaft;

a first exhaust valve opening and closing a first exhaust port which faces a combustion chamber;

a second exhaust valve opening and closing a second exhaust port which faces the combustion chamber;

a first rocker arm actuating said first exhaust valve to open and close by being pushed by said first exhaust cam;

a second rocker arm actuating said second exhaust valve to open and close by being pushed by said second exhaust cam; and a decompression mechanism rotatable in unison with said first exhaust cam projecting a decompression operator to lift said first rocker arm in a valve opening direction at a timing of a compression stroke initiated by the internal combustion engine when a rotational speed of said camshaft is lower than a predetermined rotational speed, and retracting said decompression operator when the rotational speed of said camshaft is equal to or higher than the predetermined rotational speed;

wherein said first rocker arm and said second rocker arm are provided with an angular movement transmitter transmitting a turning force produced by said decompression operator in the valve opening direction from said first rocker arm to said second rocker arm.

2. The internal combustion engine according to claim 1, wherein said angular movement transmitter includes a pair of protrusions projecting toward each other from respective rocker arm bodies of said first rocker arm and said second rocker arm and abutting against each other when said first rocker arm is turned in the valve opening direction by said decompression operator.

3. The internal combustion engine according to claim 2, wherein said protrusions are disposed on closest portions of mutually facing surfaces of the rocker arm body of said first rocker arm and the rocker arm body of said second rocker arm.

4. The internal combustion engine according to claim 2, wherein the protrusion projecting from said first rocker arm is joined to the rocker arm body of said first rocker arm by a progressively spreading contiguous arcuate surface.

5. The internal combustion engine according to claim 3, wherein the protrusion projecting from said first rocker arm is joined to the rocker arm body of said first rocker arm by a progressively spreading contiguous arcuate surface.

6. The internal combustion engine according to claim 1, wherein said angular movement transmitter has a first abutting surface on said first rocker arm and a second abutting surface on said second rocker arm, which abut against each other when said first rocker arm is turned by said decompression operator; and a clearance is provided between said first abutting surface and said second abutting surface when said decompression operator is not in operation.

7. The internal combustion engine according to claim 2, wherein said angular movement transmitter has a first abutting surface on said first rocker arm and a second abutting surface on said second rocker arm, which abut against each other when said first rocker arm is turned by said decompression operator; and a clearance is provided between said first abutting surface and said second abutting surface when said decompression operator is not in operation.

8. The internal combustion engine according to claim 3, wherein said angular movement transmitter has a first abutting surface on said first rocker arm and a second abutting surface on said second rocker arm, which abut against each other when said first rocker arm is turned by said decompression operator; and a clearance is provided between said first abutting surface and said second abutting surface when said decompression operator is not in operation.

9. The internal combustion engine according to claim 4, wherein said angular movement transmitter has a first abutting surface on said first rocker arm and a second abutting surface on said second rocker arm, which abut against each other when said first rocker arm is turned by said decompression operator; and a clearance is provided between said first abutting surface and said second abutting surface when said decompression operator is not in operation.

10. The internal combustion engine according to claim 1, wherein said angular movement transmitter has a first abutting surface on said first rocker arm and a second abutting surface on said second rocker arm, which abut against each other when said first rocker arm is turned by said decompression operator, and at least one of said first abutting surface and said second abutting surface is formed as an arcuate surface.

11. The internal combustion engine according to claim 2, wherein said angular movement transmitter has a first abutting surface on said first rocker arm and a second abutting surface on said second rocker arm, which abut against each other when said first rocker arm is turned by said decompression operator, and at least one of said first abutting surface and said second abutting surface is formed as an arcuate surface.

12. The internal combustion engine according to claim 3, wherein said angular movement transmitter has a first abutting surface on said first rocker arm and a second abutting surface on said second rocker arm, which abut against each other when said first rocker arm is turned by said decompression operator, and at least one of said first abutting surface and said second abutting surface is formed as an arcuate surface.

13. The internal combustion engine according to claim 4, wherein said angular movement transmitter has a first abutting surface on said first rocker arm and a second abutting surface on said second rocker arm, which abut against each other when said first rocker arm is turned by said decompression operator, and at least one of said first abutting surface and said second abutting surface is formed as an arcuate surface.

14. The internal combustion engine according to claim 6, wherein said angular movement transmitter has a first abutting surface on said first rocker arm and a second abutting surface on said second rocker arm, which abut against each other when said first rocker arm is turned by said decompression operator, and at least one of said first abutting surface and said second abutting surface is formed as an arcuate surface.

15. An internal combustion engine comprising:

a combustion chamber having a first exhaust port and a second exhaust port;

a camshaft operatively mounted relative to the combustion chamber, said camshaft having a first exhaust cam and a second exhaust cam on an outer circumferential surface thereof, said camshaft being rotatable in ganged relation to rotation of a crankshaft;

a first exhaust valve for opening and closing the first exhaust port;

a second exhaust valve for opening and closing the second exhaust port;

a first rocker arm for actuating said first exhaust valve to open and close, said first rocker arm being actuated by said first exhaust cam;

a second rocker arm for actuating said second exhaust valve to open and close, said second rocker arm being actuated by said second exhaust cam; and a decompression mechanism rotatable in unison with said first exhaust cam projecting a decompression operator to lift said first rocker arm in a valve opening direction at a timing of a compression stroke initiated by the internal combustion engine when a rotational speed of said camshaft is lower than a predetermined rotational speed, and retracting said decompression operator when the rotational speed of said camshaft is equal to or higher than the predetermined rotational speed;

wherein said first rocker arm and said second rocker arm are provided with an angular movement transmitter transmitting a turning force produced by said decompression operator in the valve opening direction from said first rocker arm to said second rocker arm.

16. The internal combustion engine according to claim 15, wherein said angular movement transmitter includes a pair of protrusions projecting toward each other from respective rocker arm bodies of said first rocker arm and said second rocker arm and abutting against each other when said first rocker arm is turned in the valve opening direction by said decompression operator.

17. The internal combustion engine according to claim 16, wherein said protrusions are disposed on closest portions of mutually facing surfaces of the rocker arm body of said first rocker arm and the rocker arm body of said second rocker arm.

18. The internal combustion engine according to claim 16, wherein the protrusion projecting from said first rocker arm is joined to the rocker arm body of said first rocker arm by a progressively spreading contiguous arcuate surface.

19. The internal combustion engine according to claim 15, wherein said angular movement transmitter has a first abutting surface on said first rocker arm and a second abutting surface on said second rocker arm, which abut against each other when said first rocker arm is turned by said decompression operator; and a clearance is provided between said first abutting surface and said second abutting surface when said decompression operator is not in operation.

20. The internal combustion engine according to claim 15, wherein said angular movement transmitter has a first abutting surface on said first rocker arm and a second abutting surface on said second rocker arm, which abut against each other when said first rocker arm is turned by said decompression operator, and at least one of said first abutting surface and said second abutting surface is formed as an arcuate surface.

* * * * *